United States Patent [19]

Fischer

[11] 4,429,543

[45] Feb. 7, 1984

[54] ICE MAKER

[76] Inventor: Harry C. Fischer, 1819 Adrean Pl., P.O. Box 5377, Sun City Center, Fla. 33570

[21] Appl. No.: 407,788

[22] Filed: Aug. 13, 1982

[51] Int. Cl.[3] ..... F25C 1/12

[52] U.S. Cl. ..... 62/73; 62/347; 62/352

[58] Field of Search ..... 62/66, 69, 71, 73, 340, 62/347, 348, 352

[56] References Cited

U.S. PATENT DOCUMENTS

| | | | |
|---|---|---|---|
| 2,595,588 | 5/1952 | Lee et al. | 62/73 |
| 2,997,861 | 8/1961 | Kocher et al. | 62/347 |
| 3,068,660 | 12/1962 | Council et al. | 62/352 X |
| 3,287,927 | 11/1966 | Jacobus | 62/353 X |
| 3,318,106 | 5/1967 | Litman | 62/347 X |
| 3,877,242 | 4/1975 | Creager | 62/352 X |
| 3,984,996 | 10/1976 | Bright | 62/353 |
| 3,988,903 | 11/1976 | Brewer et al. | 62/352 X |

*Primary Examiner*—William E. Tapolcai
*Attorney, Agent, or Firm*—Fitch, Even, Tabin & Flannery

[57] ABSTRACT

Ice-making apparatus having an evaporator including a helical tubing section, means for supplying water to the exterior surface thereof and means for supplying refrigerant to the evaporator to cause freezing of a helix of ice on the exterior surface thereof. An elongated driver is located axially within the helical tubing, and hot gas from the compressor frees the ice helix from its bond to helical tubing following discontinuation of supply of refrigerant thereto. The driver is rotated to slide the ice helix along the tubing and fracture the leading end of the helix into smaller ice pieces at a discharge point, preferably at the top of the unit.

A star-wheel driver may be located coaxially within the helical tubing and have four radially extending fins for engaging grooves in the interior surface of the ice helix. The four fins are warmed so as to obviate formation of a strong bond between them and the ice helix. Water fills a tubular surrounding enclosure to sufficient depth to immerse a substantial portion of helical tubing, and air is supplied to a lower location therewithin during freezing to agitate the water and promote the formation of a helix of clear ice.

10 Claims, 8 Drawing Figures

ICE MAKER

The present invention relates generally to ice-making and more particularly to a method for making pieces of ice and to apparatus for carrying out such an improved ice-making method which is capable of design to effect delivery of ice pieces to an upper location.

BACKGROUND OF THE INVENTION

There have been various attempts to make pieces of ice by forming an elongated section of ice and then somehow fracturing that ice section to form pieces which may or may not resemble ice "cubes", which are generally thought of as being formed individually, oftentimes in an individual cavity. Such apparatus is to be distinguished from continuous apparatus for making shaved ice or the like which operates on somewhat different principles and produces a soft ice.

U.S. Pat. No. 3,984,996 discloses such an ice-maker which freezes a vertical tube of ice of square cross section and employs a central rotating shaft to drive the frozen tube upward. The apparatus is designed for continuous operation in a compartment of a home-freezer and employs a pair of synchronized blade-type cutters at the top to fracture the slowly upwardly moving tube of ice into cube-like sections. U.S. Pat. Nos. 2,595,588 and 3,287,927 also disclose ice-making machines which intermittently freeze a vertical column of ice and then eject that frozen column slowly upward where a breaking mechanism is provided for fracturing the emerging column into pieces at an upper location. None of these designs has proved to be entirely satisfactory, and it is not believed that any of them has been successful commercially. Accordingly, improved designs in ice-making equipment of this type have continued to be sought after.

BRIEF SUMMARY OF THE INVENTION

A helix of ice is formed by circulating a refrigerant through the interior of a helical tubing section while water is supplied to the exterior of the tubing section, preferably by immersion. Upon achievement of a desired thickness of ice, the supply of refrigerant is discontinued and the tubing section is heated to break the ice bond. A driver is actuated to rotate the helix slidably upon the tubing section, causing the leading edge to fracture upon reaching a length of tubing disposed at an angle from the regular curvature of the helix. Preferably, the driver is heated so that it is in sliding contact with the helix and is disposed on the axial center line thereof. The helix is rotated upward so as to deliver the ice pieces into a chute at an upper location.

DETAILED DESCRIPTION OF THE PREFERRED EMBODIMENT

Figure 1:
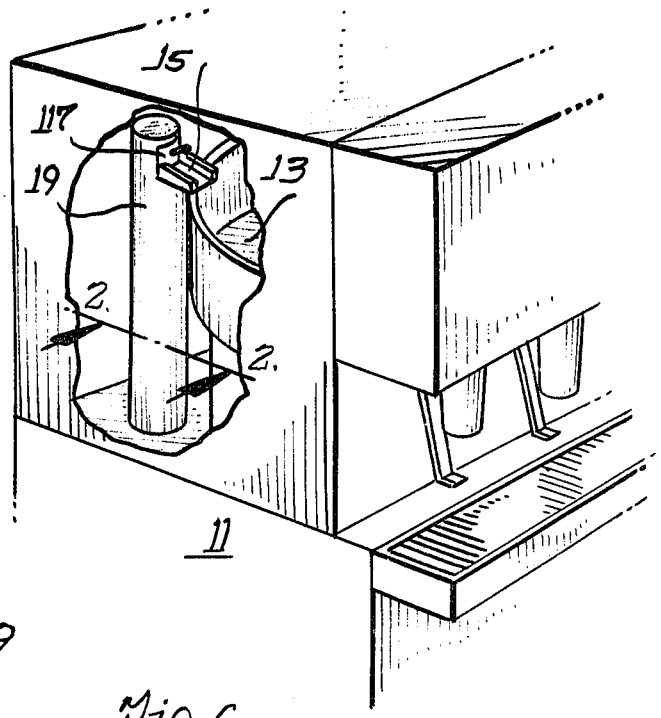
FIG. 1 is a fragmentary perspective view of dispensing apparatus including an ice-maker embodying various features of the invention.
Figure 2:
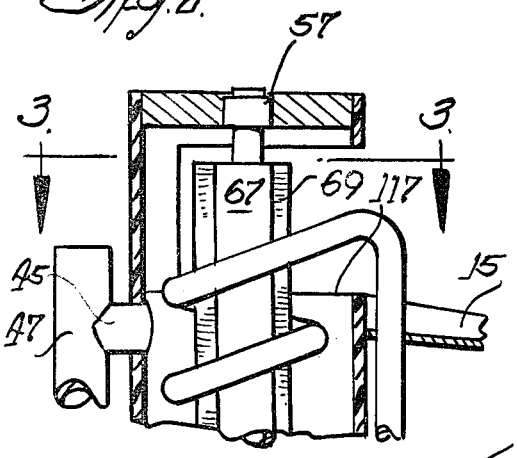
FIG. 2 is an enlarged sectional view of the ice-making portion of the apparatus of FIG. 1, enlarged in size and taken generally along the line 2—2 of FIG. 1.
Figure 2:
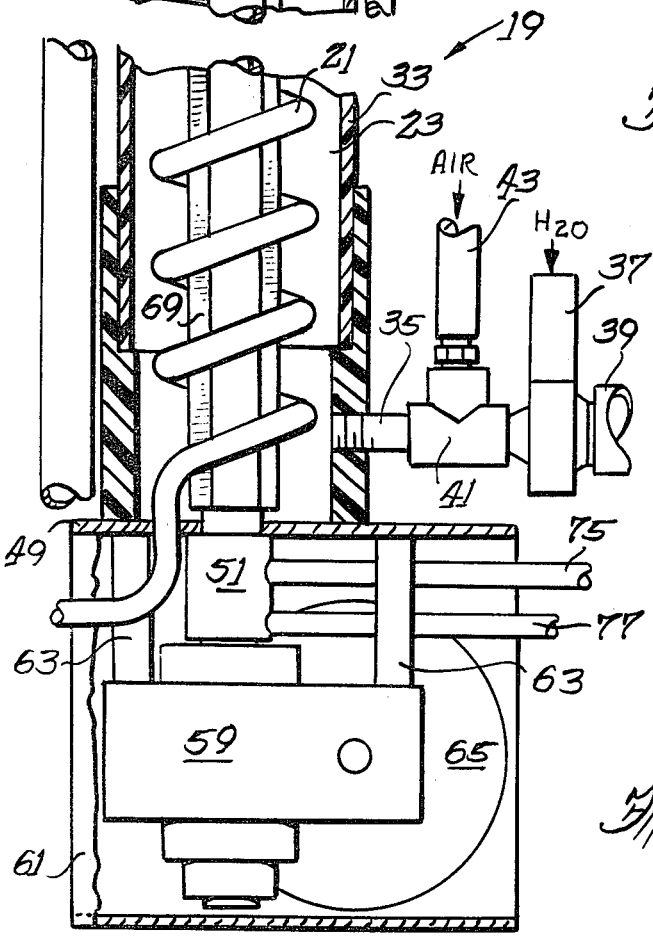
Figure 6:
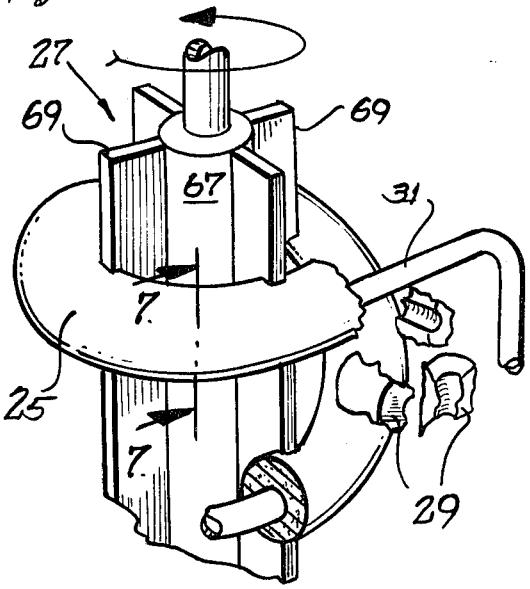
FIG. 6 is a fragmentary perspective view illustrating the formation of ice pieces from the ice helix; and FIGS. *7a* and *7b* are enlarged sectional views through the ice helix taken along line 7—7 of FIG. 6.

The invention is illustrated as a part of an overall carbonated-drink dispensing apparatus 11 which includes an ice-dispensing hopper 13 that is mounted in an upper location. Health departments throughout the United States have been advocating the ice-dispenser concept for machines of this type because ice can be dispensed mechanically, without contact with human hands, as opposed to the standard floor-mounted, reach-in ice bins. Because carbonated beverage quality depends partly on the quality of the ice, which can provide up to one-third of a good drink's volume, there are substantial advantages in being able to provide ice pieces of the quality and clarity equal to that provided by the best ice-cube-making equipment now on the market, which inherently discharge cubes from a location below the region where the freezing occurs. Accordingly, the present invention is illustrated in its preferred orientation wherein it is aligned about a vertical axis and discharges the ice pieces through a chute 15 which is in an upper location, near the top of the overall apparatus, so that the pieces can fall by gravity into the adjacent ice-dispensing hopper. However, it should be recognized that the invention is capable of operating in other than vertical orientation and is also capable of discharging into a lower chute should that be desired for some particular purpose.

Very briefly, the inventive concept provides an ice-maker 19 which incorporates a helical tubing section 21 that serves as an evaporator with water being supplied to the outer surface thereof. In the illustrated embodiment, the helical tubing section 21 is disposed in a surrounding well 23 of circular cross section which is filled with water to the desired depth to immerse substantially the entire helical tubing section. A low-boiling liquid refrigerant, such as Freon-22, is supplied to the interior of the tubing section 21 and circulated therethrough. The evaporating refrigerant takes up heat from the surrounding water causing a helix of ice 25 to form on the exterior surface of the tubing section.

When the ice helix 25 reaches the desired wall thickness, by which time it will have grown into engagement with an axially located rotatable driver 27, the supply of refrigerant is halted and the tubing section is heated so as to break the thermal bond between the interior surface of the ice helix and the exterior surface of the tubing. The driver 27 is then rotated causing the helix of ice to unwind by traveling upward in sliding contact with the tubing section 21. The leading edge of the helix is caused to fracture into ice pieces 29, and although any suitable fracturing device can be used, preferably the helical tubing section 21 continues as a short length 31 that is disposed either as a straight section or as an upwardly or sidewardly curved section which causes the rigid ice helix to fracture as the leading end of the rigid ice helix is forced to try to follow a different curvature. The ice pieces 27 fall into the chute 15, and the well is preferably being refilled with water during the unwinding of the helix so that any pieces that fracture and fall directly downward are floated to the top and directed by the driver to the discharge chute. The driver 27 is heated to a temperature above the freezing point of water during the freezing portion of the cycle so that it remains in sliding contact with the ice helix, preferably by circulating the liquid refrigerant from the condenser to an interior section of the driver —an operation which simultaneously subcools the refrigerant, increasing its cooling capacity upon expansion.

More specifically, the ice-maker 19 is constructed with the helical tubing section 21 disposed about a vertical axis and located within a well 23 which is formed by an outer tube 33 made of synthetic resin material and having an interior diameter just larger than the exterior diameter of the ice helix it is intended to form; however, a tube of substantially larger diameter could be used if desired. Preferably, the tube 33 is formed from polyvinylchloride, polypropylene or a similar material which will not form a strong bond to the ice helix should the helix be inadvertently allowed to grow slightly oversize. Water enters the well 23 through a lower inlet 35 to which a water supply line 37 is connected. The supply line 37 is provided with a solenoid-operated off-on valve 39 to control the flow of water. Connected in the supply line 37 at a location downstream of the solenoid valve 39 is a tee 41 which interconnects with an air supply line 43 which continuously bubbles air through the well for a purpose to be described hereinafter. A water overflow outlet 45 is provided near the top of the well 23 and connects to a drain pipe 47 to carry away the overflowing water.

The tube 33 which defines the well is mounted at its bottom on a support plate 49 and suitably sealed by a gasket. The driver 27 is mounted in a suitable base 51 which depends from the support plate 49 and has a collar portion 53 at the upper end thereof which extends through an opening in the support plate and is affixed thereto (see FIG. 4). The driver 27 includes a central, elongated shaft 55 which extends from a bushing 57 mounted in the top of the tube 33 through the passageway in the base 51 and into a gear reducer 59. The gear reducer 59 is supported in a surrounding housing 61 disposed below the support plate 49 and is suitably mounted by a plurality of posts 63 which depend from the plate 49. The gear reducer is mechanically connected to an electric drive motor 65 which is also disposed in the housing 61.

Figure 4:
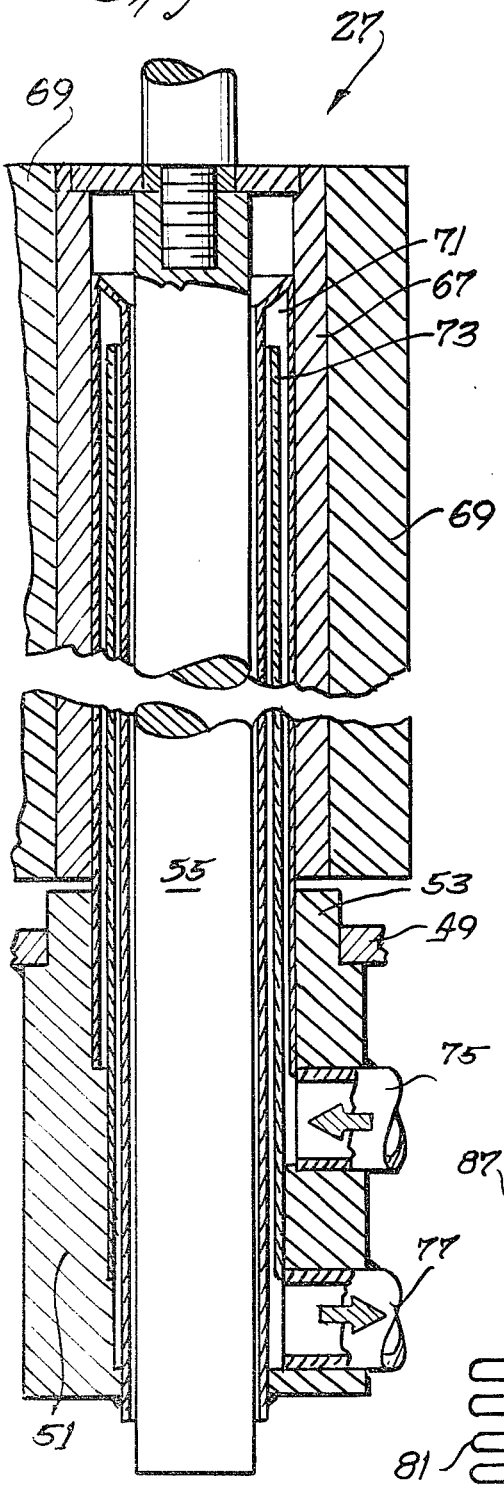
FIG. 4 is an enlarged fragmentary sectional view showing details of the interior drive member and taken generally along the line 4—4 of FIG. 3.
Figure 3:
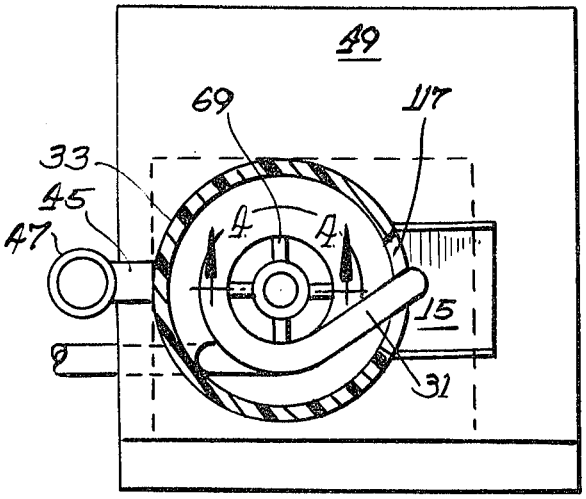
FIG. 3 is a sectional view of the ice-maker taken generally along the line 3—3 of FIG. 2.

The central shaft 55, at a location just below its upper end which is received in the bushing 57, supports an elongated, depending tubular sheath 67 which is located coaxially with the shaft and which supports four radially extending fins 69 disposed at about 90° to one another, as best seen in FIG. 3. As seen in FIG. 4, the interior diameter of the sheath 67 is substantially larger than the outer diameter of the central shaft 55 so that it is spaced therefrom to provide an annular region therebetween. Disposed in this region is a hollow heat-exchanger 71 which is stationarily affixed to the driver base 51 and the outer surface of which is dimensioned so as to lie in sliding, thermally conducting contact with the interior surface of the sheath 67. As seen in FIG. 4, the heat-exchanger 71 includes a central baffle 73 which is coaxially located and divides the heat-exchanger into an inner and outer chamber. The outer chamber is in connection with an inlet tube 75 extending through an opening in the base 51, and the inner chamber is in connection with an outlet tube 77 extending through a slightly lower opening in the base 51.

Figure 5:
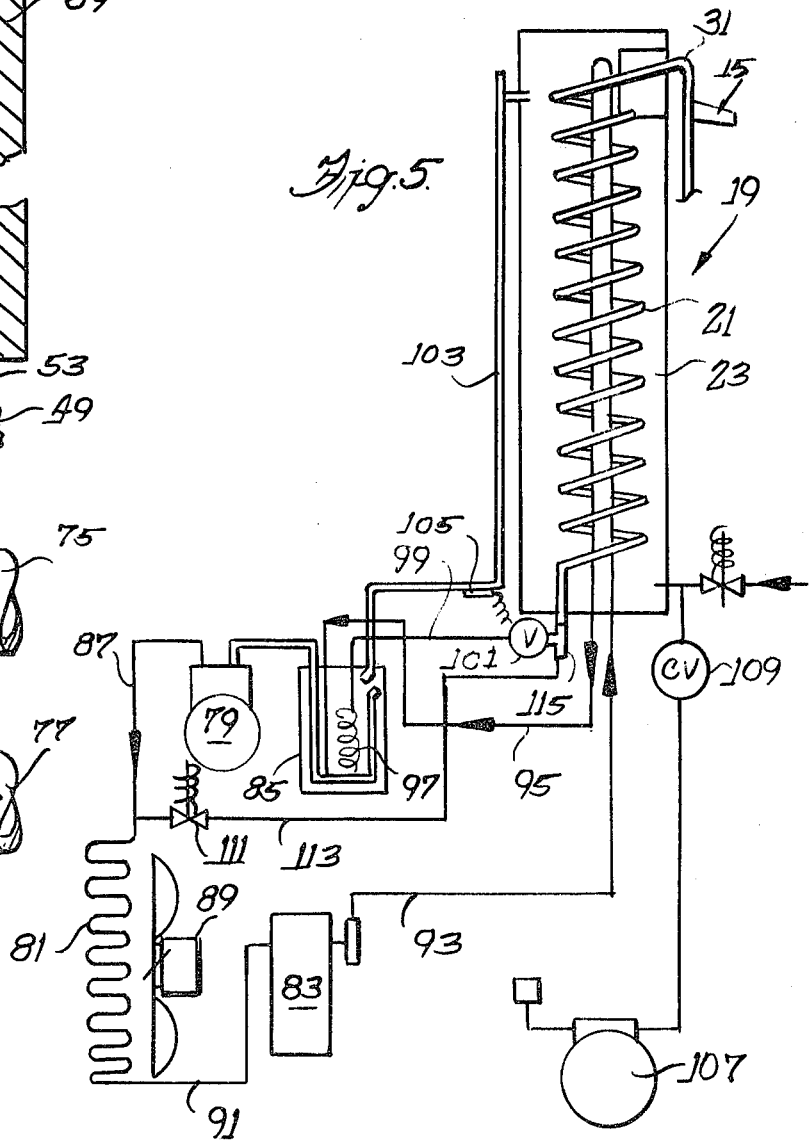
FIG. 5 is a schematic view illustrating the operation of the ice-making apparatus.

As best seen in FIG. 5, the refrigeration system contains a number of the standard components usually present, including a compressor 79, a condenser 81, a receiver 83 for the liquid from the condenser and an accumulator 85 from which the compressor takes suction. The refrigerant which is used is a relatively low-boiling chlorinated-fluorocarbon, such as R-22, e.g., Freon-22, which has suitable physical characteristics. Low-pressure refrigerant vapor accumulates in the accumulator 85, and the compressor 79 takes suction from a conventional U-tube within the accumulator. The high-pressure refrigerant gas is discharged through a line 87 leading to the condenser 81 where the high-pressure gas gives up its heat to the atmosphere, aided by air flow therepast created by a motor-driven fan 89, causing the high-pressure vapor to condense to liquid that flows through a line 91 to the receiver 83.

The warm high-pressure liquid refrigerant exits from the receiver 83 by a line 93 which leads to the inlet tube 75 for the annular heat-exchanger 71. The warm high-pressure liquid refrigerant gives off sufficient heat in the heat-exchanger 71 to maintain the sheath and its attached fins 69 above the freezing point of water. It flows upward over the top of the baffle 73 and then downward exiting through the outlet tube 77 and flowing through a line 95 leading to a coil 97 located in the bottom of the accumulator. The liquid exiting the top of the coil flows through a line 99 leading to the lower end of the helical tubing section 21, which line 99 contains a thermostatically-controlled expansion valve 101. The vapor exiting through the short straight section 31 at the top of the helical coil section 21 enters a return line 103 leading to the accumulator 85. The expansion valve 101 is controlled by a temperature sensor 105 mounted on the return line 103, although other equivalent control devices might be substituted.

The ice-maker 19 operates on a cyclic basis wherein first freezing of the ice helix occurs, followed by heating to break the bond between the ice helix and the tubing, followed by harvesting by fracturing the leading edge of the helix into pieces, with the cycle being repeated so long as there is a demand in the ice-dispensing hopper 13 for ice pieces. As a first step in the cycle, the control system opens the solenoid valve for a sufficient period of time to fill the well with water, and the control is such that about 20% more water is supplied than the well 23 will hold. The excess overflows through the overflow outlet 45 into the drain 47, and in this manner there is sufficient dilution and flushing of the residual water that the build-up of mineral impurities is avoided.

After the well is full, the thermostatically-controlled valve 101 operates, and the high-pressure liquid from the coil 97 is allowed to expand into the bottom of the helical evaporator 21 lowering its temperature below the freezing point of water and beginning the build-up of a film of water ice on the exterior surface of the helical tubing section. The vapor returns through the line 103 where its temperature is monitored by the sensor 105, and the valve 101 changes in response to the temperature monitored to either increase or decrease the rate of expansion of liquid therethrough so as to achieve a desired amount of superheat of the vapor in the return line. The returning vapor in the accumulator effects some additional cooling of the liquid in the coil 97 flowing toward the valve.

Air agitation throughout the well is employed in order to produce clear ice instead of cloudy ice, and the flow of air is carried out continuously during the time when the ice-maker is operating. Air at the desired flow rate is supplied via a small electric motor-driven diaphram pump or the like 107 (FIG. 5) which discharges through a check valve 109 into the air supply line 43 which connects to the tee 41 downstream of the water inlet solenoid valve.

Figure 7A:
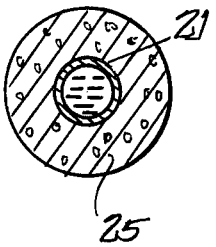

When the ice helix has been built up on the helical tubing to the desired thickness, e.g., about 3/16–⅜ of an inch, as illustrated in FIG. 7*a*, the harvesting cycle begins. The thickness of the ice can be determined using any of several different measurements well known in the art; however, it has been found preferable and simplest to simply maintain a timed operation whereby freezing is carried out for a time of, for example, ten to fifteen minutes. When the control system timer reaches the end of the set period, a signal is sent which opens a solenoid-controlled valve 111 located in a bypass line 113 leading from the outlet line from the compressor 79 to a tee 115 in the line 99 downstream of the expansion valve 101 which simultaneously closes. As a result, hot high-pressure gas from the compressor is fed into the bottom of the helical tubing section 21 raising its temperature above 32° F. (0° C.). A substantial portion of the hot vapor may condense on the interior wall of the evaporator, and it flows through the return line 103 to the accumulator where it is trapped in the bottom. It may remain there until the next freezing cycle when the warmer liquid flowing through the coil contributes sufficient heat to vaporize it prior to its suction through the compressor.

Figure 7B:
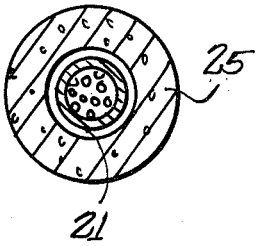

After the hot gas valve 111 has been open for about thirty seconds, the bond between the exterior of the helical tubing 21 and the interior surface of the ice helix 25 has been broken so the ice helix is loose on the helical tubing as illustrated in FIG. 7*b*. The control system timer then energizes the electric motor 65 which in turn drives the central driver shaft 55 through the gear reducer 59 causing the sheath 67 and its four radially extending fins 69 to slowly rotate. The fins extend vertically for the entire length of the helical section and are of such a radial length that they extend into the region wherein the ice helix 25 has been formed. Accordingly, the ice helix has four vertical notches in its interior surface at the location of each of the fins, and because of the heating of the sheath and the fins which results from the circulation of the warm liquid refrigerant through the annular heat exchanger 71, the fins have remained at a temperature above the freezing point of water so that there is no ice bond between them and the helix.

Because the ice helix 25 is now loose on the helical tubing, each turn of the driver 27 screws the ice helix upward at a rate equal to the pitch of the helix, e.g., one inch per revolution. As the relatively rigid ice helix reaches the short straight section 31 at the end of the evaporator, the ice fractures into small pieces 29. The straight section 31 extends through a discharge opening 117 in the upper wall of the polyvinylchloride tube 33, and the chute 15 is located at the lower edge of the opening 117. At the same time as or a predetermined time after the driver begins to screw the ice helix 25 upward, the control timer opens the solenoid valve 39 in the water supply line, and later closes the hot gas valve 111 a few seconds before the drive motor is deenergized. As a result, the well begins to refill with water, and the flow rate permitted by the valve is such that, by the time the trailing edge of the ice helix reaches the top, the level of water in the well 23 has reached the overflow opening. As a result, any ice pieces near the trailing end of the helix which break off float to the top and are directed to the chute 15 by the rotating fins 69.

Following closing of the hot gas valve 111, the following freezing cycle is ready to begin, and the expansion valve 101 again operates to supply refrigerant to the evaporator. The timed flow of water may continue for a short period until the approximate 20% excess has exited through the discharge opening.

Generally, it can be seen that the invention provides a helical tubing section through which cold refrigerant is circulated which is preferably immersed in water that is being agitated with air. Although water could be sprayed onto the tubing, immersion is somewhat simpler. After the bond between the tubing and the ice is broken by heating the tubing, the ice helix is driven toward one end where fracturing is suitably carried out. Although fracturing is simply carried out by a short straight section at the upper end of the helix, the short length might be bent upward on a suitable radius of curvature, and the radius can be varied slightly so as to change the size of the fractured fragments, the size being controlled somewhat by the presence of the notches along the interior where the edges of the blades reside. Although some alternative drive to the star-wheel driver illustrated might be employed, and in this respect driving by contact at the exterior surface could be used, preferably a rotatable driver disposed interior of the helical tubing and coaxial therewith is used. One example of a helix that has proved suitable is a stainless steel tube from about ⅜ inch in outer diameter which is formed into a helix about 32 inches high, with the outer diameter of the helix measuring about two and ⅜ inches. In an ice-maker using a helical coil of such proportions, about 70% of the water in the well is frozen during each freezing cycle. Of course, the remaining about 30% is diluted with the next filling of water, and the substantial amount of overflow prevents any significant mineral build-up.

Although the invention has been described with regard to a preferred embodiment, various changes and modifications as would be obvious to one having the ordinary skill in the art might be made without deviating from the scope of the invention which is set forth in the appended claims. For example, although there are substantial advantages in being able to operate an ice-maker which produces ice pieces at an elevated location near the top of all of the operating mechanism, such as allowing the overall equipment to have a fairly low profile, for particular applications this may not be an important consideration. In such an instance, instead of having the drive for the star-wheel driver 27 disposed therebelow, it could be reversed and located above the helical evaporator. Likewise, in either instance, the water could be drained from the well at the conclusion of the freezing cycle during defrost, and the ice helix could be screwed downward so that the lower end becomes the leading edge which fractures into the ice pieces. Similarly, the helix could be disposed in a horizontal or any other orientation although, as previously indicated, there are particular advantages which result from the vertical orientation illustrated.

Particular features of the invention are emphasized in the claims which follow.

What is claimed is:

1. Ice-making apparatus which comprises evaporator means including a helical tubing section, elongated drive means located adjacent said helical tubing section, means for supplying water to the exterior surface of said helical tubing section, means for supplying refrigerant to said evaporator means so that evaporation takes place within said helical section causing the freezing of a helix of ice on the exterior surface of said helical tubing section, means for heating said tubing section above the freezing point of water to free said ice helix from its bond to said evaporator helical tubing section following discontinuation of supply of refrigerant thereto, and means for causing said drive means to rotate said ice helix and fracture the leading end of said helix into smaller ice pieces at a discharge point.

2. Apparatus in accordance with claim 1 wherein said helical tubing section is positioned with its axis vertical and wherein said driver means includes a rotatable shaft located coaxially within said helical tubing section and having at least one radially extending fin for engaging the interior of said ice helix and means for causing said shaft to rotate about a vertical axis.

3. Apparatus in accordance with claim 2 wherein means is provided for warming said fin so as to obviate formation of a strong bond between said fin and said ice helix.

4. Apparatus in accordance with claim 1 wherein said means for fracturing said ice helix includes a tube section at one end of said helical section having a different radius of curvature than that of said helical section.

5. Apparatus in accordance with claim 1 wherein tubular enclosure means is provided substantially coaxial with and surrounding said helical tubing section, and wherein said discharge point is located at an upper location above said helical tubing section whereby water can be supplied to said enclosure means at a lower location and ice pieces can be discharged at an elevated location.

6. Apparatus in accordance with claim 5 wherein said water supply means fills said tubular enclosure with sufficient water to immerse a substantial portion of said helical tubing section and, wherein means is provided for supplying air to a lower location within said water-filled tubular enclosure during the time of said freezing so as to agitate said water and promote the formation of a helix of clear ice.

7. Apparatus in accordance with claim 6 wherein said tubular enclosure is provided by a tube of circular cross section made from a synthetic resin material having a surface that resists formation of a strong ice bond thereto.

8. Apparatus in accordance with claim 2 wherein a compressor and condenser are provided for withdrawing evaporated refrigerant from said evaporator means, increasing the pressure thereof and condensing said higher pressure refrigerant, and wherein said elongated driver is heated to a temperature above about the freezing point of water by circulation of said condensed liquid refrigerant therethrough so as to subcool said liquid refrigerant from the condenser before same is supplied to said evaporator means.

9. Apparatus in accordance with claim 8 wherein mounted on said shaft is a sheath made of material having good thermal conductivity and wherein said means for heating said fin includes a generally annular heat-exchanger in thermal contact with said rotatable sheath upon which said fin is mounted.

10. A method for making pieces of water ice, which method comprises supplying refrigerant to the interior of a helical tubing section, supplying water to the exterior of said helical tubing section, said refrigerant being at a temperature such that the freezing of a helix of ice occurs on the exterior surface of said helical tubing section, heating said helical tubing section above the freezing point of water to free said ice helix from its bond to said tubing following discontinuation of supply of refrigerant thereto, and axially rotating said ice helix and fracturing the leading end of said helix into smaller ice pieces.

* * * * *